US007959494B1

(12) United States Patent
Pietrzak

(10) Patent No.: US 7,959,494 B1
(45) Date of Patent: Jun. 14, 2011

(54) SHARPENING CUTTING BLADES HAVING A PROGRESSIVELY CHANGING CUTTING ANGLE

(76) Inventor: Leonard D. Pietrzak, Dingmans Ferry, PA (US)

( * ) Notice: Subject to any disclaimer, the term of this patent is extended or adjusted under 35 U.S.C. 154(b) by 924 days.

(21) Appl. No.: 11/866,044

(22) Filed: Oct. 2, 2007

(51) Int. Cl.
*B24B 1/00* (2006.01)

(52) U.S. Cl. ..... 451/45; 451/293; 451/371

(58) Field of Classification Search ..... 451/45, 451/193, 273, 278, 293, 321, 367, 371, 405, 451/420, 917
See application file for complete search history.

(56) References Cited

U.S. PATENT DOCUMENTS

| | | | | | |
|---|---|---|---|---|---|
| 2,578,309 | A * | 12/1951 | Kroczek | 451/278 |
| 4,528,778 | A * | 7/1985 | Wolff | 451/224 |
| 5,157,870 | A * | 10/1992 | Pike | 451/273 |
| 5,547,419 | A * | 8/1996 | Hulnicki | 451/321 |
| 5,667,427 | A * | 9/1997 | Airhart et al. | 451/45 |
| 5,941,763 | A * | 8/1999 | Kaye | 451/278 |
| 6,364,750 | B2 | 4/2002 | Bauer | |
| 6,821,193 | B2 | 11/2004 | Kaye | |
| 7,118,466 | B2 * | 10/2006 | Laney | 451/293 |
| 7,465,220 | B1 * | 12/2008 | Wolff | 451/45 |
| 2002/0025757 | A1 * | 2/2002 | Gross | 451/5 |
| 2006/0111027 | A1 * | 5/2006 | Laney | 451/293 |

* cited by examiner

*Primary Examiner* — Eileen P. Morgan
(74) *Attorney, Agent, or Firm* — Arthur Jacob

(57) ABSTRACT

A blade, such as the blade of a precision shear, having a cutting angle which changes progressively along the length of the blade through a predetermined angular measure is sharpened by coupling the blade with an articulated arm assembly through a drive mechanism which rotates the blade about a longitudinal direction in response to movement of the blade along the longitudinal direction, as the blade is drawn across a sharpening surface. The drive mechanism includes a cam and follower for rotating the blade through an angular displacement corresponding to the predetermined angular measure of the change in the cutting angle so as to preserve the changing cutting angle. The drive mechanism is selectively uncoupled to permit free manual rotation of the blade as the blade is drawn across the sharpening surface for finishing the blade subsequent to the sharpening operation. The drive mechanism accommodates blades of both right-handed shears and left-handed shears.

10 Claims, 8 Drawing Sheets

SHARPENING CUTTING BLADES HAVING A PROGRESSIVELY CHANGING CUTTING ANGLE

The present invention relates generally to sharpening cutting blades and pertains, more specifically, to effecting precise sharpening of cutting blades, such as the blades of a precision shear, in which the cutting angle made by the cutting face at the cutting edge of the blade changes progressively along the length of the blade, through a predetermined angular measure.

In the construction of precision shears, such as those used by professional hair stylists, the cutting blades of the shear are provided with a cutting face, or "ride", which makes a prescribed cutting angle, or "ride angle", at the cutting edge of the blade, along the length of the blade. Most frequently, that cutting angle is about 45°, and usually lies within the range of about 30° to 60°. In order to maximize performance and increase longevity, the finest of these currently available shears are provided with a ride angle which changes slightly, progressively along the length of the ride through a predetermined angular measure, from a greater, or steeper, ride angle at the tip of the blade to a slightly smaller, or less steep, ride angle adjacent the fulcrum of the blade. A predominant current industry standard for the predetermined angular measure of the change is 2.14° per inch along the length of the ride.

When it becomes time to sharpen the blade, a sharpener must follow precisely the change in the ride angle along the length of the blade, if the original precision is to be retained. While various fixtures have been made available to assist a sharpener in holding a shear blade during the performance of a sharpening operation, heretofore, none have been provided with the ability to guide an operator in following precisely the changing ride angle along the length of a blade being sharpened. Accordingly, professional sharpeners have relied upon skill and experience to manipulate a shear blade manually in order to follow the changing ride angle as the blade is drawn across a sharpening surface. In many instances, a sharpener will choose to ignore the changing ride angle, with the result that the sharpened shear either becomes impaired or entirely ruined. Such a result is unacceptable, especially in view of the high cost of precision shears and the degree of performance demanded of such shears.

The present invention provides the professional sharpener with the ability to follow the changing ride angle along a blade during a sharpening operation without relying solely upon manual skill. As such, the present invention attains several objects and advantages, some of which are summarized as follows: Assists a professional sharpener in achieving exceptional precision during the sharpening of blades in which the ride angle changes progressively along the length of the ride, without relying solely upon the manual skill of the professional sharpener; facilitates the accomplishment of precise sharpening of cutting blades, and especially the blades of precision shears, in less time and with increased accuracy; enables preservation of the high degree of performance and increased longevity provided by precision shears in which the ride angle changes progressively along the length of the ride; increases the confidence of a professional sharpener in the ability to sharpen high-performance, costly shears expeditiously, and with a greater degree of safety and precision; militates against impairment and possible ruin of precision shears as a result of a sharpening operation; readily maintains the high performance of precision cutting blades, and especially those of precision shears; replaces heretofore manually estimated sharpening with precise guided sharpening of precision cutting blades; requires only limited skills in order to accomplish expeditious, effective and precise sharpening of precision cutting blades.

The above objects and advantages, as well as further objects and advantages, are attained by the present invention which may be described briefly as apparatus for use in connection with a sharpening surface for sharpening a blade having a cutting edge and a cutting face with a length extending along the cutting edge and establishing a cutting angle at the cutting edge, the cutting angle changing progressively along the length of the cutting face through a predetermined angular measure, the apparatus comprising: an articulated arm assembly; a securing assembly including a clamping arrangement for selectively securing the blade within the securing assembly; and a coupling arrangement coupling the securing assembly with the articulated arm assembly such that upon placement of the articulated arm assembly so as to locate the securing assembly in juxtaposition with the sharpening surface, the securing assembly will be placed at a sharpening angle relative to the sharpening surface and will be movable along a sharpening path of travel extending in a longitudinal direction across the sharpening surface; the coupling arrangement including a drive mechanism for rotating the securing assembly about the longitudinal direction in response to movement of the securing assembly along the sharpening path of travel to change the sharpening angle progressively through a sharpening angular displacement corresponding to the predetermined angular measure of the change in the cutting angle as the securing assembly is moved along the sharpening path of travel with the blade drawn across the sharpening surface.

In addition, the present invention provides a method for sharpening a blade having a cutting edge and a cutting face with a length extending along the cutting edge and establishing a cutting angle at the cutting edge, the cutting angle changing progressively along the length of the cutting face through a predetermined angular measure, the method comprising: selectively securing the blade within a securing assembly coupled with an articulated arm assembly; placing the articulated arm assembly so as to locate the securing assembly in juxtaposition with a sharpening surface; placing the securing assembly at a sharpening angle relative to the sharpening surface to place the blade at the sharpening angle relative to the sharpening surface such that the securing assembly, and the blade secured therein, will be movable along a sharpening path of travel extending in a longitudinal direction across the sharpening surface; coupling a drive mechanism with the securing assembly such that upon movement of the securing assembly, and the blade secured therein, along the sharpening path of travel the securing assembly will be rotated about the longitudinal direction in response to movement of the securing assembly along the sharpening path of travel to change the sharpening angle progressively through a sharpening angular displacement corresponding to the predetermined angular measure of the change in the cutting angle as the securing assembly is moved along the sharpening path of travel; and moving the securing assembly, and the blade secured therein, along the sharpening path of travel such that the blade is drawn across the sharpening surface as the sharpening angle is changed progressively through the sharpening angular displacement.

The invention will be understood more fully, while still further objects and advantages will become apparent, in the following detailed description of preferred embodiments of the invention illustrated in the accompanying drawing, in which.

Figure 1:
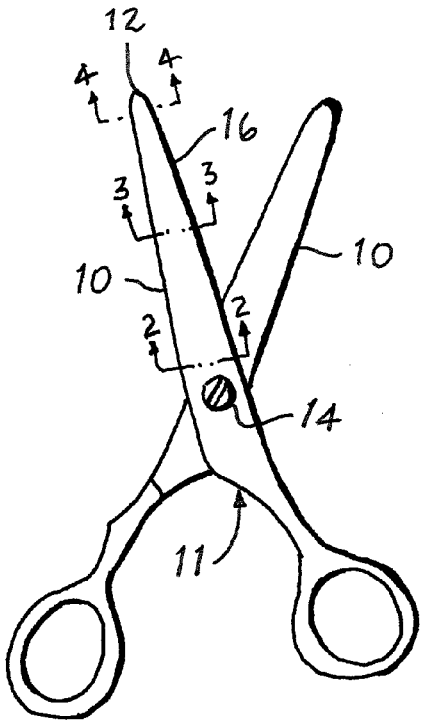
FIG. 1 is a plan view of a precision shear having blades to be sharpened in apparatus of the present invention in accordance with the present invention.
Figure 2:
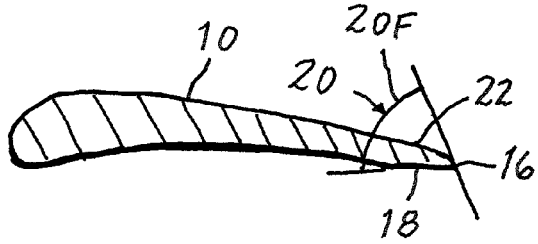
FIG. 2 is an enlarged, diagrammatic cross-sectional view taken along line 2-2 of FIG. 1.
Figure 3:
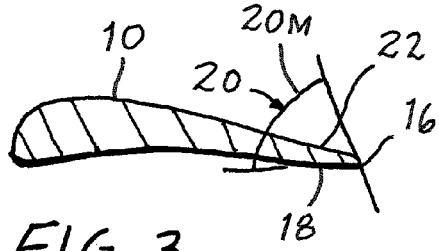
FIG. 3 is an enlarged, diagrammatic cross-sectional view taken along line 3-3 of FIG. 1.
Figure 4:
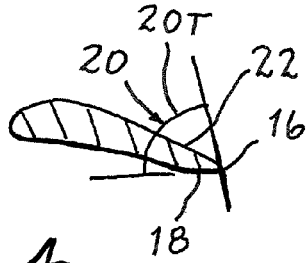
FIG. 4 is an enlarged, diagrammatic cross-sectional view taken along line 4-4 of FIG. 1.

Referring now to the drawing, and especially to FIGS. 1 through 4 thereof, a cutting blade to be sharpened in accordance with the present invention is illustrated in the form of a blade 10 of a precision shear 11, shear 11 being comprised of two blades 10. Each blade 10 has a length which extends longitudinally from a tip 12 to a fulcrum 14 and includes a cutting edge 16 along the length of the blade 10. Blade 10 is provided with a cutting face, or "ride" 18, which makes a prescribed cutting angle, shown as "ride" angle 20, with the spine 22 of the blade 10, where the ride 18 and the spine 22 intersect along the cutting edge 16. In order to provide the shear with exemplary performance and to increase longevity of the blade 10, the ride angle 20 is made to change slightly, progressively along the length of the ride 18, through a predetermined angular measure, from a steeper angle at the tip 12 of the blade 10 to a slightly smaller, less steep angle adjacent the fulcrum 14. Thus, as best seen in FIGS. 2 through 4, a typical ride angle 20, shown to be nominally 45°, changes progressively from a ride angle 20F adjacent the fulcrum 14, toward a slightly steeper ride angle 20M intermediate the tip 12 and the fulcrum 14, to an even steeper ride angle 20T adjacent the tip 12. A predominant current industry standard for the predetermined angular measure of the change in the ride angle is 2.14° per inch along the length of the ride 18.

Figure 5:
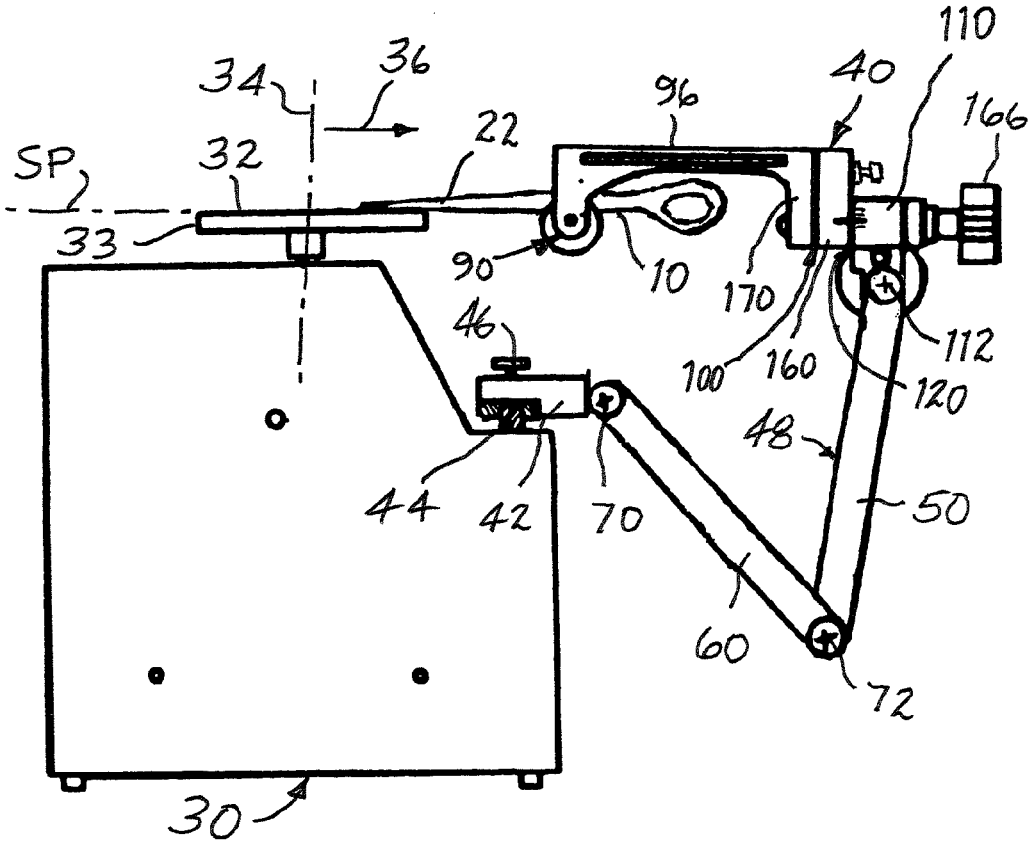
FIG. 5 is a somewhat diagrammatic side elevational view of a sharpening machine utilizing an apparatus constructed in accordance with the present invention to sharpen a blade in accordance with the present invention.
Figure 6:
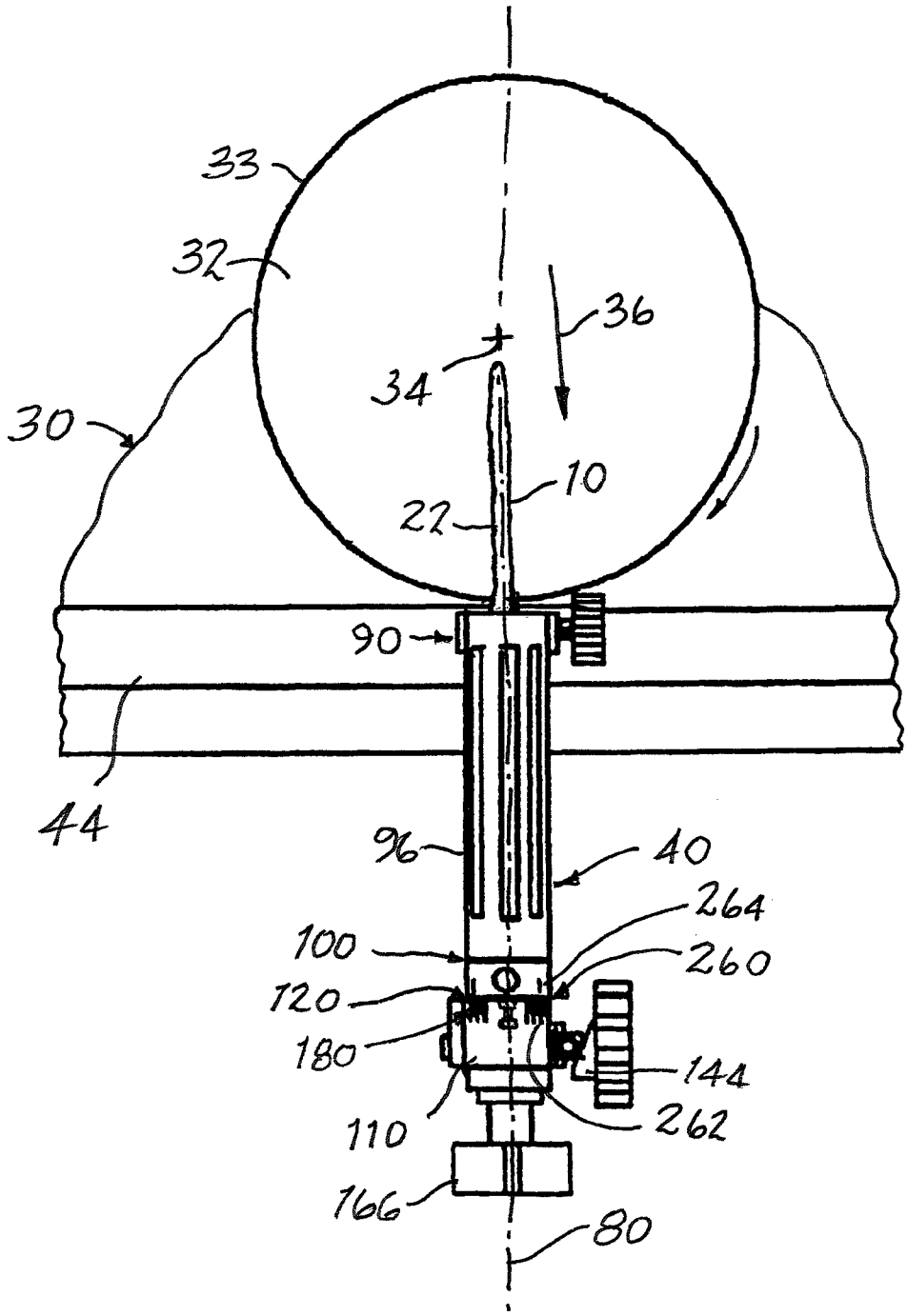
FIG. 6 is an enlarged, fragmentary top plan view showing a portion of the items depicted in FIG. 5.

The present invention assists a sharpener in following the progressively changing ride angle 20 during sharpening of blade 10. Turning now to FIGS. 5 and 6, a sharpening machine 30 is seen to include a sharpening surface which, in this instance, comprises a planar sharpening surface 32 of a sharpening disk 33, the sharpening surface 32 extending in a sharpening plane SP and being rotated about an altitudinal axis 34 in a now-conventional manner. Sharpening of blade 10 is to be effected by placing the blade 10 in juxtaposition with the sharpening surface 32, with the spine 22 engaged with the sharpening surface 32 and the ride 18 oriented at ride angle 20 relative to the sharpening plane SP, which sharpening plane SP is essentially normal to the altitudinal axis 34, and then manually drawing the blade 10 across the sharpening surface 32 in a longitudinal direction 36 until the length of the spine 22 corresponding to the length of the ride 18 has been operated upon by the sharpening surface 32. In order to assist the sharpener in following the progressively changing ride angle 20 as the blade 10 is drawn across the sharpening surface 32, an apparatus constructed in accordance with the present invention, seen at 40, is shown attached to the sharpening machine 30, in place to guide the sharpener through a sharpening operation.

Figure 7:
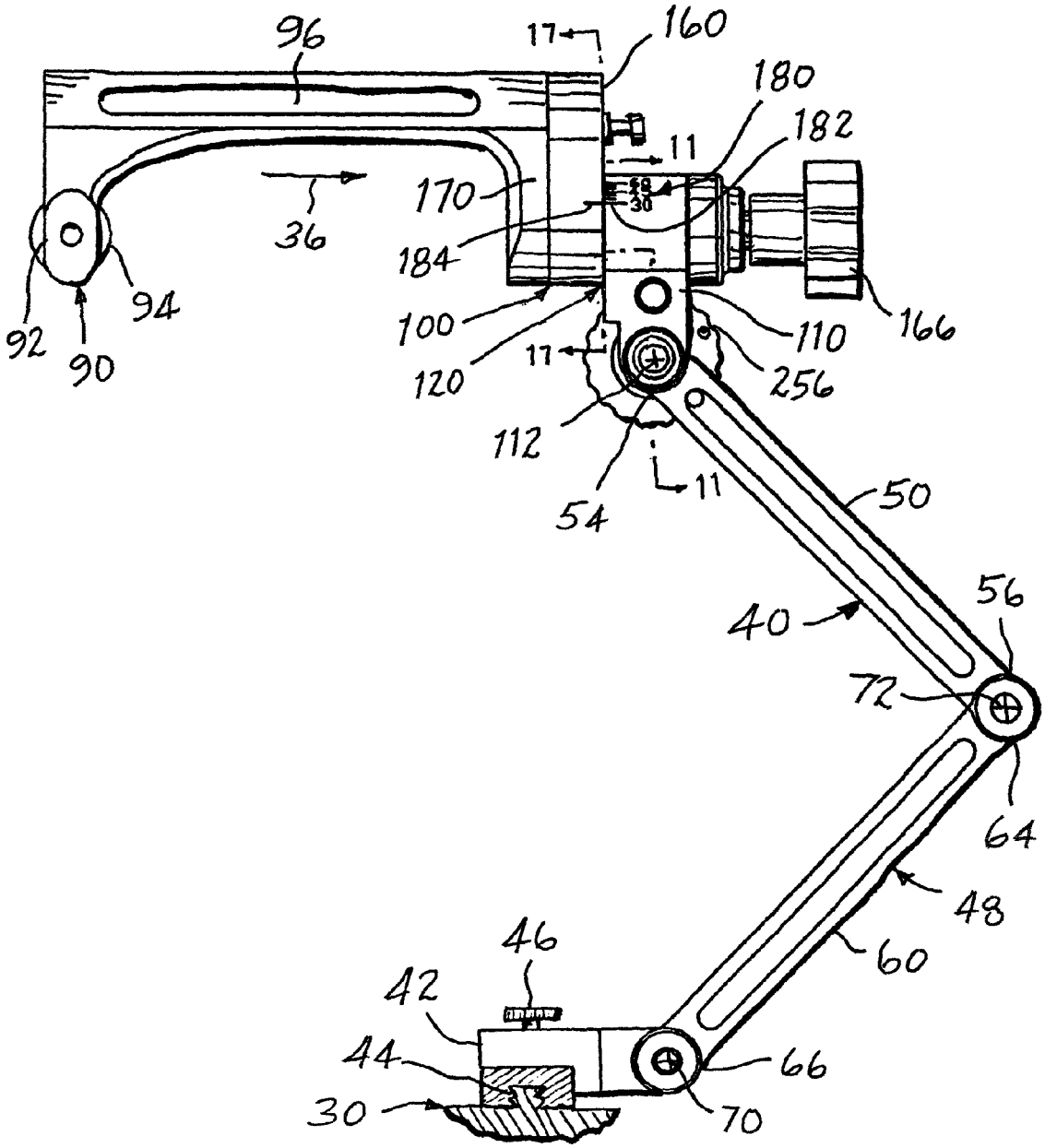
FIG. 7 is a side elevational view of an apparatus constructed in accordance with the present invention.

Referring now to FIG. 7, as well as to FIGS. 5 and 6, apparatus 40 has a basal member 42 mounted upon the sharpening machine 30 along a track 44 which extends laterally across machine 30, the engagement being such that the basal member 42, and the apparatus 40, are movable selectively along the track 44 to a selected lateral position on the track 44. A clamping screw 46 affixes the basal member 42 to the track 44 at the selected lateral position.

Basal member 42 carries an articulated arm assembly 48 having a first arm in the form of upper arm 50, extending between a first, or upper end 54, and a second, or lower end 56, and a second arm in the form of lower arm 60, extending between a first or upper end 64 and a second, or lower end 66. Lower arm 60 is mounted, at lower end 66, upon the basal member 42 for pivotal movement about a lower lateral axis 70, while upper arm 50 is mounted, at lower end 56, upon the lower arm 60, at the upper end 64 of the lower arm 60, for pivotal movement about an upper lateral axis 72. The lateral axes 70 and 72 are essentially parallel to one another so that movement of the upper end 54 of the upper arm 50 is confined to movement parallel to an altitudinal plane 80.

Figure 8:
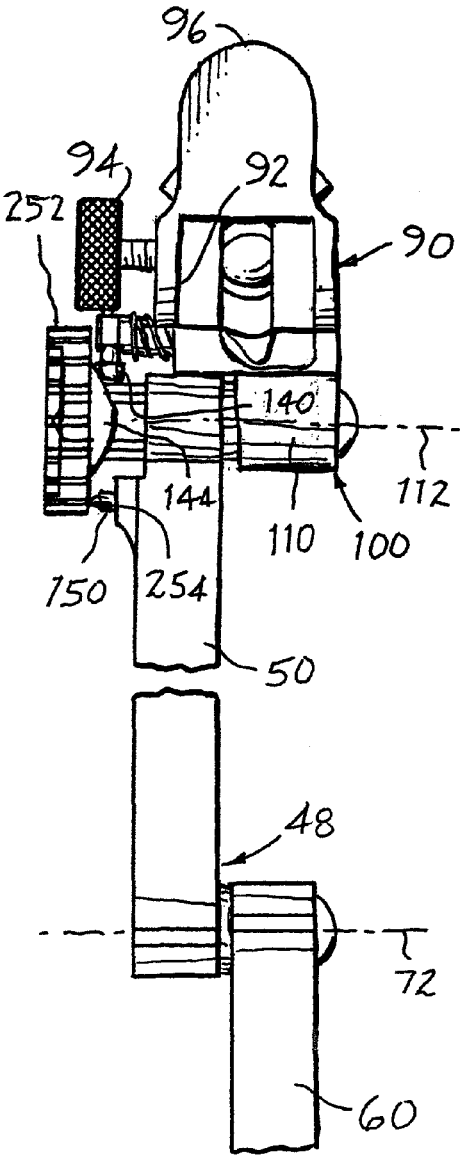
FIG. 8 is an enlarged fragmentary front elevational view of the apparatus.
Figure 9:
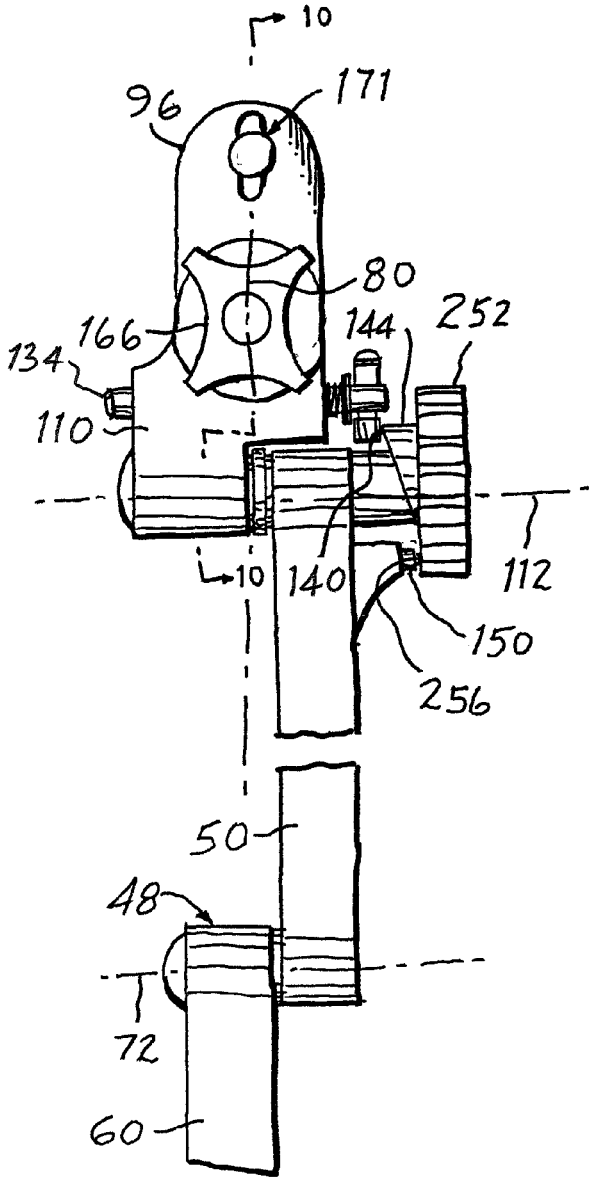
FIG. 9 is an enlarged fragmentary rear elevational view of the apparatus.

Turning now to FIGS. 8 and 9, as well as to FIGS. 5 through 7, a securing assembly 90 includes a clamping arrangement in the form of a clamp 92 having a clamping screw 94 for selectively securing the blade 10 within the securing assembly 90, and a handle in the form of a hand grip 96 which enables a sharpener to grip the securing assembly 90 and move the blade 10 along longitudinal direction 36 essentially within the altitudinal plane 80, as set forth in greater detail below. A coupling arrangement 100 couples the securing assembly 90 with the articulated arm assembly 48 and includes a bracket 110 mounted upon the upper arm 50 of the articulated arm assembly 48, at the upper end 54 of the upper arm 50, for pivotal movement about a pivotal axis 112 which extends laterally essentially parallel to lateral axes 70 and 72 such that movement of the bracket 110, and the blade 10 secured in the clamp 92, is confined by the articulated arm assembly 48 to movement essentially within the altitudinal plane 80.

Figure 10:
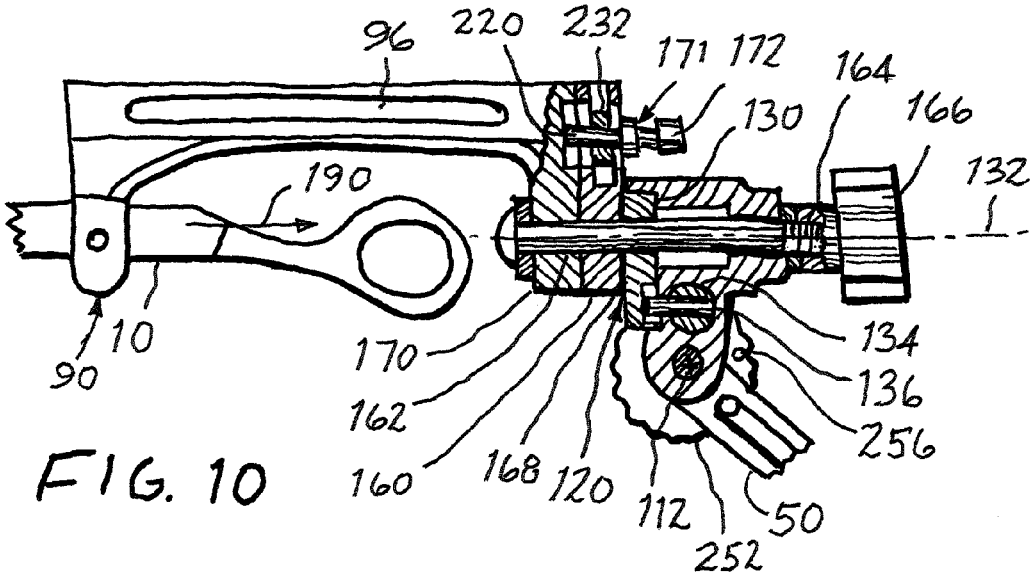
FIG. 10 is cross-sectional view taken along line 10-10 of FIG. 9, slightly reduced in size.
Figure 11:
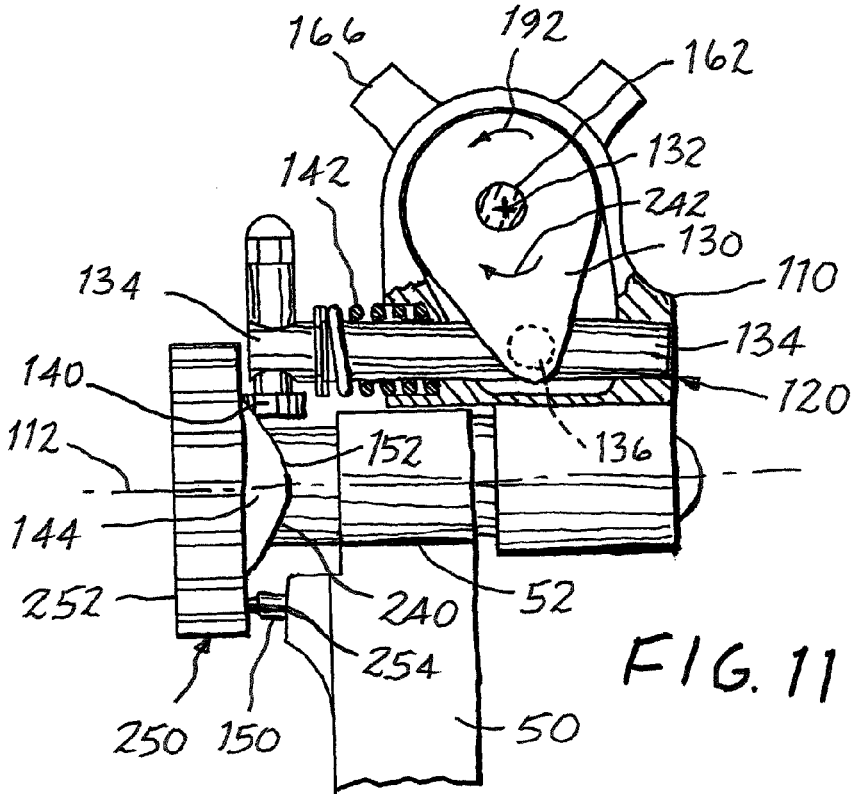
FIG. 11 is an enlarged cross-sectional view taken along line 11-11 of FIG. 7.

Coupling arrangement 100 includes a drive mechanism 120 which rotates the securing assembly 90, and the blade 10 secured therein, about the longitudinal direction 36 as the securing assembly 90 is moved along the longitudinal direction 36. Thus, as best seen in FIGS. 10 and 11, together with FIGS. 7 through 9, drive mechanism 120 includes a crank 130 journaled for rotation within bracket 110 about a longitudinal axis 132 located within altitudinal plane 80. A connecting rod 134 extends in a lateral direction through the bracket 110, is arranged for sliding movement within the bracket 110 in lateral directions, and is coupled with crank 130 by a crank pin 136. A follower 140 is carried by the connecting rod 134 and is biased by a helical spring 142 into engagement with a cam 144 carried by upper arm 50, at the upper end 52 of the upper arm 50. Cam 144 is journaled for rotation relative to bracket 110 about pivotal axis 112 and is fixed against rotation relative to the upper end 52 of upper arm 50 by a detent 150 which precludes rotation of the cam 144 relative to the upper end 52 of upper arm 50. Detent 150 is carried by upper arm 50 and retains cam 144 in a prescribed fixed position relative to the upper end 52 of upper arm 50, with cam 144 presenting a corresponding contoured surface portion 152 to the follower 140.

A clutch link 160 is affixed to a drive shaft 162 which extends along longitudinal axis 132 and passes through crank 130 so as to provide a threaded segment 164 extending longitudinally beyond the bracket 110, rearwardly of the bracket 110. A knob 166 is threaded onto segment 164 of the drive shaft 162 such that upon tightening the knob 166 the clutch link 160 is drawn against forward face 168 of the crank 130, which forward face 168 is spaced axially a slight distance away form bracket 110, enabling frictional engagement of the clutch link 160 with the crank 130 to couple clutch link 160 with crank 130 for movement of the clutch link 160 in unison with the crank 130. Hand grip 96 includes a depending leg 170 which is mounted upon drive shaft 162 for pivotal movement relative to clutch link 160 about longitudinal axis 132, for purposes set forth in detail below; however, at this juncture, hand grip 96 is fixed against such rotation relative to clutch link 160 by an engagement arrangement 171 that includes a selector 172 which secures the hand grip 96 against rotation relative to clutch link 130 such that hand grip 96 will rotate about longitudinal axis 132 with rotation of the clutch link 130 which, in turn, is rotated by crank 130.

Figure 12:
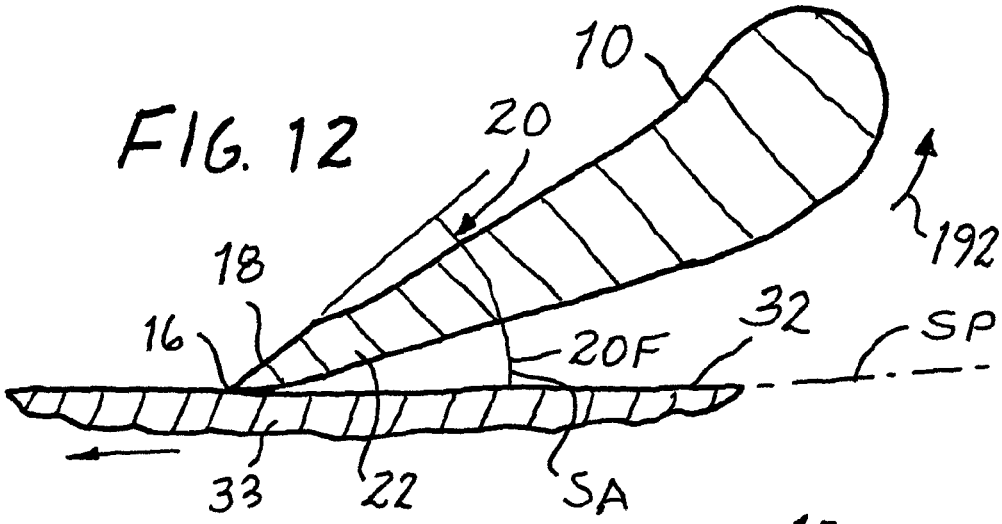
FIGS. 12 through 14 are diagrammatic illustrations depicting a sharpening operation conducted in accordance with the present invention.
Figure 13:
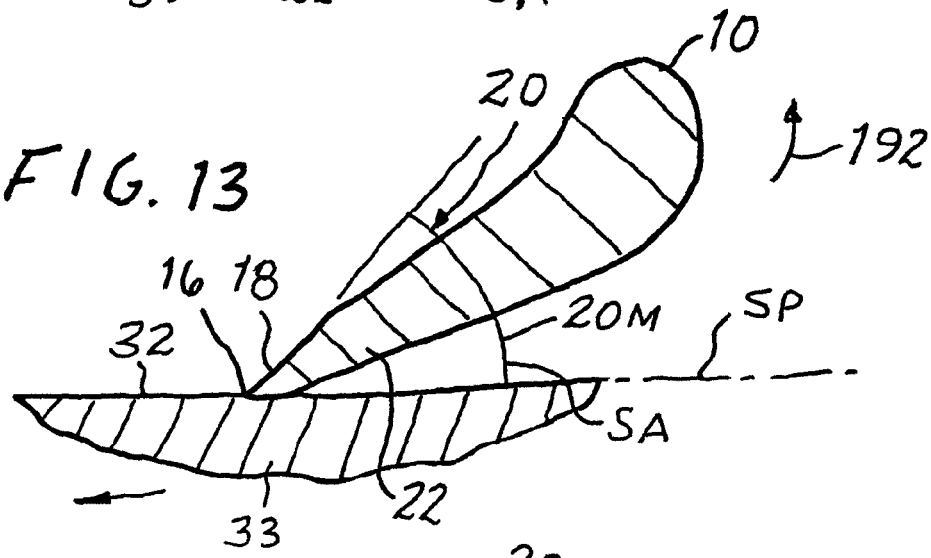
Figure 14:
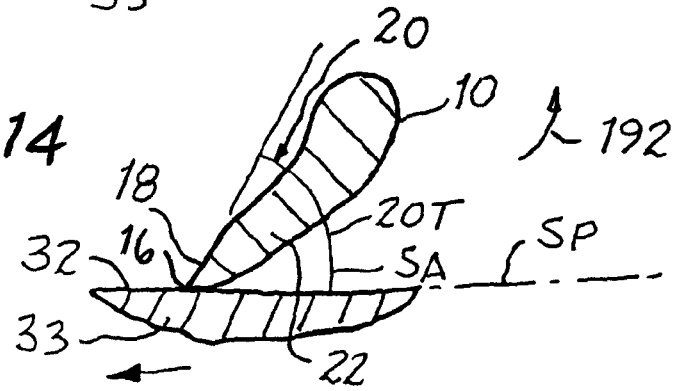

Referring now to FIGS. 12 through 14, in connection with FIGS. 7 through 11, a sharpening operation is conducted as follows: With blade 10 clamped within clamp 92, a sharpener (an operator) will loosen knob 166 to uncouple the clutch link 160 from the crank 130 and permit manual setting of the angular position of clamp 92, and the blade 10, relative to the sharpening plane SP such that the spine 22 of blade 10 adjacent the fulcrum 14 of blade 10 will be placed within sharpening plane SP and will rest against the sharpening surface 32, with ride 18 making a sharpening angle SA with the sharpening surface 32, as illustrated diagrammatically in FIG. 12, the sharpening angle SA corresponding to the ride angle 20. The setting of the angular position is facilitated by a visual indicator 180 which includes a scale 182 on bracket 110 (see FIG. 7), calibrated in ride angle, and a reference mark 184 on the clutch link 160. Since the ride angle 20 of blade 10 usually is known by the sharpener prior to commencement of a sharpening operation, the indicator 180 enables a quick and accurate manual setting of the correct angular position of blade 10 relative to the sharpening surface 32. Once set, the angular position is fixed by tightening the knob 166 to engage and couple the clutch link 160 with the crank 130.

The sharpener then starts the sharpening machine 30 to commence rotation of the sharpening disk 33. The sharpener then grips the hand grip 96 and, with the blade 10 juxtaposed with the sharpening surface 32, and the spine 22 of blade 10 adjacent the fulcrum 14 of the blade 10 placed against the sharpening surface 32, as seen in FIG. 12, the sharpener draws the blade 10 along a sharpening path of travel 190 (see FIG. 6) to effect sharpening of the blade 10 along the spine 22. The sharpening path of travel 190 extends in longitudinal direction 36 and is confined to the altitudinal plane 80 by the articulated arm assembly 48, thereby guiding the sharpener in maintaining an appropriate longitudinal sharpening path of travel. As the blade 10 is drawn along the sharpening path of travel 190, the drive mechanism 120 will change the sharpening angle SA progressively through a sharpening angular displacement corresponding to the predetermined angular measure in the change of the ride angle 20 along the length of the blade 10. Thus, the bracket 110 will rotate about pivotal axis 112 in response to longitudinal movement of the upper end 52 of upper arm 50 as the hand grip 96 is drawn along the path of travel 190, and the follower 140 will traverse the contoured surface portion 152 of the cam 144, which cam 144 is held stationary relative to the upper end 52 of upper arm 50, effecting rotation of the crank 130 and the hand grip 96 through a rotational movement 192 about longitudinal axis 132 and, consequently, driving the blade 10 through a progressive sharpening angular displacement corresponding to that rotational movement.

The contoured surface portion 152 of cam 144 is calibrated so that the progressive angular displacement of the blade 10 is in accordance with the predetermined angular measure of the progressive change in the ride angle 20 along the length of the blade 10, as illustrated diagrammatically in FIGS. 12 through 14 wherein the ride angle 20 is seen to change progressively from less steep ride angle 20F adjacent the fulcrum 14 of the blade 10, as seen in FIG. 12, to steeper ride angle 20M intermediate the fulcrum 14 and tip 12 of the blade 10, as seen in FIG. 13, to still steeper ride angle 20T adjacent the tip 12 of the blade 10, as seen in FIG. 14, the changes in the ride angle being exaggerated in the drawing for illustrative purposes only. As discussed above, a predominant current industry standard for the progressive change in the ride angle along the length of a precision shear blade is 2.14° per inch along the length of the ride 18. Accordingly, in the preferred embodiment of the present invention, the contoured surface portion 152 of cam 144 is calibrated to effect a progressive angular displacement which will follow that measure of progressive change.

Figure 15:
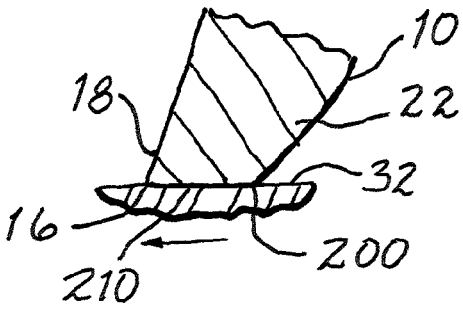
FIGS. 15 and 16 are diagrammatic illustrations depicting a blending operation conducted in accordance with the present invention.
Figure 16:
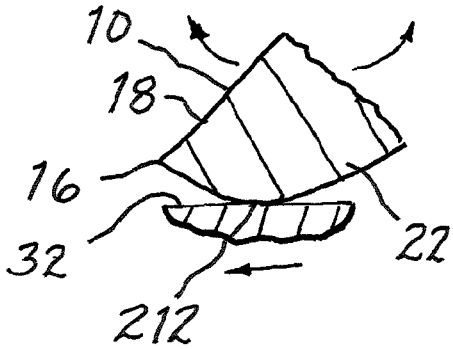

Turning now to FIGS. 15 and 16, upon completion of the sharpening operation along the length of the ride 18, a discernable edge 200 will appear along the intersection between the newly-formed surface 210 and the remainder of the spine 22 of the blade 10, the depiction of the edge 200 as well as the dimensions of the surface 210 relative to the remainder of the spine 22 being exaggerated in the drawing, as shown in FIG. 15, for illustrative purposes only. For smoothness of use of a professional shear, as well as for aesthetic reasons, sharpeners prefer to eliminate such a discernable edge 200 in favor of a more rounded blend between the cutting edge 16 and the remainder of the spine 22, as depicted at 212 in FIG. 16, again with exaggeration for illustrative purposes only. Accordingly, the present invention provides for selectively disengaging the hand grip 96 from the clutch link 160, and from the drive mechanism 120, so that the hand grip 96, and the blade 10, can be rotated freely about the longitudinal axis 132 as the hand grip 96, and the blade 10, are moved along the longitudinal direction 36, guided to remain essentially within the altitudinal plane 80 by the articulated arm assembly 48.

Figure 17:
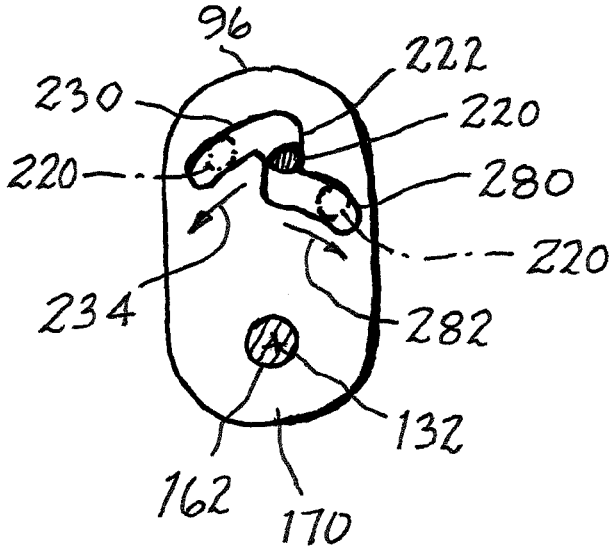
FIG. 17 is an enlarged cross-sectional view taken along line 17-17 of FIG. 7.

To that end, the selector 172 of the engagement arrangement 171 includes a drive pin 220 selectively movable among three positions on the clutch link 160. As best seen in FIG. 17, viewed in connection with FIG. 10, during sharpening operations wherein the hand grip 96, and the blade 10, are rotated through a progressively changing angular displacement, drive pin 220 is placed in a central position wherein the drive pin 220 is engaged with a radial slot 222 in the depending leg 170 of the hand grip 96, as shown in full lines in FIG. 17. The engagement of drive pin 220 within the radial slot 222 serves to couple the leg 170 with the clutch link 160 such that both the clutch link 160 and the hand grip 96 will rotate as a unit about the longitudinal axis 132. Radial slot 222 communicates with a circumferential slot 230 such that upon selective movement of the drive pin 220 into an upper position, shown in phantom, wherein drive pin 220 is in engagement with the circumferential slot 230, the hand grip 96 is free to rotate about the longitudinal axis 132 in response to manual manipulation of the hand grip 96, within the confines delineated by the circumferential length of slot 230. Upon completion of a sharpening operation, the sharpener can selectively move the drive pin 220 out of the central position to move the drive pin 220 out of the radial slot 222, and into the upper position to engage the drive pin 220 with the circumferential slot 230. The engagement arrangement 171 includes a detent mechanism 232 coupled with selector 172 for retaining the drive pin 220 in either selected one of the central and upper positions. The sharpener then can proceed to rotate the blade manually, as the blade is drawn along the sharpening surface 32, and thereby eliminate the unwanted edge 200, in favor of a rounded blend at 212, as described above in connection with FIGS. 15 and 16. The circumferential slot 230 extends away from radial slot 222 in a lateral direction 234 so as to be placed at a location laterally offset from the radial slot 222 in the lateral direction 234, thereby enabling spine 22 of blade 10 to be engaged with sharpening surface 32 adjacent edge 200 for completing the desired rounded blend at 212 during a rounding operation. In addition, the circumferential slot 230 is made long enough circumferentially to enable full free rotation for manually completing the desired rounding of the blade along the spine of the blade.

It is noted that the free manual rotation of hand grip 96 permitted by the engagement arrangement 171, which includes selector 172, is enabled without disturbing the sharpening angle SA previously set by engaging the clutch link 160 with drive mechanism 120, through crank 130, with the sharpening angle SA indicated by the indicator 180. Thus, one blade of a shear may be sharpened and completed through the desired rounding operation while retaining the original setting of the sharpening angle SA unchanged so that upon removal of the one finished blade from the clamp 92, the other blade of the shear may be clamped in place in clamp 92 with precisely the same setting of the sharpening angle SA, thereby assuring that both blades of the shear will be sharpened at precisely the same sharpening angle and attaining the desired precision sharpening of the shear.

Shear 11 is a right-handed shear and the description set forth immediately above describes the sharpening of the blades of a right-handed shear. Each of the two blades of the shear includes a ride having a ride angle which changes progressively in the same angular direction along the length of the blade. In a left-handed shear, the angular change in the ride angle along the blades is in an angular direction opposite to the direction of angular change in the ride angle along the blade of a right-handed shear. Accordingly, the drive mechanism 120 is constructed so as to accommodate the blades of either a right-handed shear or a left-handed shear. Thus, cam 144 is provided with a further contoured surface portion 240 calibrated to permit the follower 140 and, consequently, the crank 130 to move in a direction opposite to the direction described above, thereby effecting rotation of the crank 130 in direction 242 (see FIG. 11), opposite to the direction 192, and effecting corresponding rotation of the clutch link 160, the hand grip 96, and ultimately the blade secured in the securing assembly 90, to change the sharpening angle SA progressively through a sharpening angular displacement corresponding to the predetermined angular measure of the change in the ride angle along the length of the blade currently being sharpened.

Returning now to FIGS. 9 through 11, an indexing arrangement 250 includes a dial 252 integral with the cam 144, and the contoured surface portions 152 and 240 of the cam 144, the dial 252 having a diameter sufficient to enable gripping by the sharpener (the operator) for selectively rotating the cam 144 about pivotal axis 112 to index the cam 144 and place the cam 144 in either one of two angular positions, including a first position, shown in FIG. 11 and described above, in which the contoured surface portion 152 is in place for being traversed by the follower 140, and a second position, shown in FIG. 9, wherein the further contoured surface portion 240 is in place for being traversed by the follower 140 during movement of the blade being sharpened, along the sharpening path of travel 190. The detent 150 includes alternate detent elements 254 and 256 on the cam 144 for fixing the cam 144 at either selected one of the two angular positions, thereby enabling the sharpener to select the appropriate position of the cam 144 in accordance with the particular blade to be sharpened. Once the angular position of the cam 144 is selected, the setting of the desired angular position of the blade is facilitated either by the above described indicator 180, where the particular blade is for a right-handed shear or, where the blade is from a left-handed shear, by a second visual indicator 260 (see FIG. 6) which includes a second scale 262 on the bracket 110, calibrated in ride angle, and a second reference mark 264 on the clutch link 160, the selection of which of the two indicators 180 or 260 being determined by which of the two positions of the cam 144 is selected. The sharpening of the blades of a left-handed shear then is accomplished in the same manner as described above in connection with the sharpening of the blades of a right-handed shear.

Upon completion of a sharpening operation along a blade of a left-handed shear, selector 172 of the engagement arrangement 171 enables selective disengagement of the hand grip 96 from the clutch link 160, and from the drive mechanism 120, so that the hand grip 96, and the blade, can be rotated freely about the longitudinal axis 132 as the hand grip 96, and the blade, are moved along the longitudinal direction 36, to accomplish a rounding operation, in the manner described above in connection with effecting a rounded blend in a blade of a right-handed shear. However, rounding of a left-handed shear blade requires that the rotation about the longitudinal axis 132 take place at a location offset laterally from radial slot 222 in a direction opposite to the lateral direction 234 of the laterally offset location provided by circumferential slot 230.

Accordingly, the engagement arrangement 171 includes a further circumferential slot 280 communicating with radial slot 222 such that upon selective movement of the drive pin 220 into a lower position, shown in phantom in FIG. 17, wherein drive pin 220 is placed into engagement with the further slot 280, and the hand grip 96 is free to rotate about the longitudinal axis 132 in response to manual manipulation of the hand grip 96, within the confines delineated by the circumferential length of further slot 280. Upon completion of a sharpening operation in connection with the blade of a left-handed shear, the sharpener can selectively move the drive pin 220 out of the central position and, consequently, out of the radial slot 222, and place the drive pin 220 at the lower position, wherein the drive pin 220 is engaged with further circumferential slot 280. Detent mechanism 232 will retain drive pin 220 in the selected lower position.

The sharpener then can proceed to rotate the blade manually, as the blade is drawn along the sharpening surface 32 and thereby complete a rounding operation, as described above in connection with FIGS. 15 and 16. The further circumferential slot 280 extends away from radial slot 222 in a lateral direction 282 which is opposite to lateral direction 234 so as to place the further circumferential slot 280 at a location laterally offset from the radial slot 222 in the lateral direction 282, thereby enabling completion of the desired rounding operation conducted upon a blade of a left-handed shear. As with circumferential slot 230, further circumferential slot 280 is made long enough circumferentially to enable full free rotation for manually completing the desired rounding of the blade along the spine of the blade.

In this manner, the present invention relieves the sharpener from manually estimating the change in ride angle along the length of a blade being sharpened and provides for rapid and accurate sharpening of a blade having a progressively changing ride angle.

It will be seen that the present invention attains all of the objects and advantages summarized above, namely: Assists a professional sharpener in achieving exceptional precision during the sharpening of blades in which the ride angle changes progressively along the length of the ride, without relying solely upon the manual skill of the professional sharpener; facilitates the accomplishment of precise sharpening of cutting blades, and especially the blades of precision shears, in less time and with increased accuracy; enables preservation of the high degree of performance and increased longevity provided by precision shears in which the ride angle changes progressively along the length of the ride; increases the confidence of a professional sharpener in the ability to sharpen high-performance, costly shears expeditiously, and with a greater degree of safety and precision; militates against impairment and possible ruin of precision shears as a result of a sharpening operation; readily maintains the high performance of precision cutting blades, and especially those of precision shears; replaces heretofore manually estimated sharpening with precise guided sharpening of precision cutting blades; requires only limited skills in order to accomplish expeditious, effective and precise sharpening of precision cutting blades.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for use in connection with a sharpening surface for sharpening a blade having a cutting edge and a cutting face with a length extending along the cutting edge and establishing a cutting angle at the cutting edge, the cutting angle changing progressively along the length of the cutting face through a predetermined angular measure, the apparatus comprising:

an articulated arm assembly;

a securing assembly including a clamping arrangement for selectively securing the blade within the securing assembly; and a coupling arrangement coupling the securing assembly with the articulated arm assembly such that upon placement of the articulated arm assembly so as to locate the securing assembly in juxtaposition with the sharpening surface, the securing assembly will be placed at a sharpening angle relative to the sharpening surface and will be movable along a sharpening path of travel extending in a longitudinal direction across the sharpening surface;

the coupling arrangement including a drive mechanism for rotating the securing assembly about the longitudinal direction in response to movement of the securing assembly along the sharpening path of travel to change the sharpening angle progressively through a sharpening angular displacement corresponding to the predetermined angular measure of the change in the cutting angle as the securing assembly is moved along the sharpening path of travel with the blade drawn across the sharpening surface;

the drive mechanism including a cam journaled for rotation relative to the securing assembly in response to movement of the securing assembly along the sharpening path of travel, and a follower engaging the cam and coupled with the securing assembly for rotation of the securing assembly about the longitudinal direction in response to rotation of the cam.

2. The apparatus of claim 1 wherein the blade comprises a precision shear blade and the predetermined angular measure is about 2.14° per inch of the length of the cutting face, and the sharpening angular displacement is about 2.14° per inch of travel along the sharpening path of travel.

3. The apparatus of claim 1 wherein:

the articulating arm assembly includes a first arm extending between first and second ends;

the coupling arrangement includes a bracket mounted for pivotal movement relative to the first arm, about a first pivotal axis extending transverse to the longitudinal direction of travel of the securing assembly, adjacent the first end of the first arm;

the securing assembly is carried by the bracket;

the first arm is mounted for pivotal movement about a second pivotal axis adjacent the second end of the first arm, the second pivotal axis being essentially parallel with the first pivotal axis;

the cam is mounted upon the first arm, adjacent the first end of the first arm, in a stationary position relative to the first arm; and the bracket carries the follower such that upon movement of the securing assembly along the sharpening path of travel the first arm will be pivoted about the second pivotal axis while the bracket is pivoted about the first pivotal axis, and relative motion between the follower and the cam will rotate the securing assembly about the longitudinal direction.

4. The apparatus of claim 3 wherein the stationary position of the cam on the first arm is one of two selectable stationary positions, the two stationary positions including a first position wherein the cam and the follower are engaged for rotation of the securing assembly in a first direction of rotation, and a second position wherein the cam and the follower are engaged for rotation of the securing assembly in a second direction of rotation opposite to the first direction of rotation, and the apparatus includes an indexing arrangement for enabling selective placement of the cam in either one of the first and second positions.

5. The apparatus of claim 1 wherein the securing assembly includes a handle enabling gripping of the securing assembly for manual movement of the securing assembly along the sharpening path of travel.

6. The apparatus of claim 5 wherein the coupling arrangement includes an engagement arrangement for selectively engaging the drive mechanism with the securing assembly for rotation of the securing assembly about the longitudinal direction in response to movement of the securing assembly along the sharpening path of travel, and selectively disengaging the drive mechanism from the securing assembly for enabling free manual rotation of the securing assembly about the longitudinal direction.

7. A method for sharpening a blade having a cutting edge and a cutting face with a length extending along the cutting edge and establishing a cutting angle at the cutting edge, the cutting angle changing progressively along the length of the cutting face through a predetermined angular measure, the method comprising:

selectively securing the blade within a securing assembly coupled with an articulated arm assembly;

placing the articulated arm assembly so as to locate the securing assembly in juxtaposition with a sharpening surface;

placing the securing assembly at a sharpening angle relative to the sharpening surface to place the blade at the sharpening angle relative to the sharpening surface such that the securing assembly, and the blade secured therein, will be movable along a sharpening path of travel extending in a longitudinal direction across the sharpening surface;

coupling a drive mechanism with the securing assembly, the drive mechanism including a cam journaled for rotation relative to the securing assembly in response to movement of the securing assembly along the sharpening path of travel, and a follower engaging the cam and coupled with the securing assembly for rotation of the securing assembly about the longitudinal direction in response to rotation of the cam such that upon movement of the securing assembly, and the blade secured therein, along the sharpening path of travel the securing assembly will be rotated about the longitudinal direction in response to movement of the securing assembly along the sharpening path of travel to change the sharpening angle progressively through a sharpening angular displacement corresponding to the predetermined angular measure of the change in the cutting angle as the securing assembly is moved along the sharpening path of travel; and moving the securing assembly, and the blade secured therein, along the sharpening path of travel such that the blade is drawn across the sharpening surface as the sharpening angle is changed progressively through the sharpening angular displacement.

8. The method of claim 7 wherein the blade comprises a precision shear blade and the predetermined angular measure is about 2.14° per inch of the length of the cutting face, and the sharpening angular displacement is about 2.14° per inch of travel along the sharpening path of travel.

9. The method of claim 7 wherein the securing assembly is moved along the sharpening path of travel by grasping a handle on the securing assembly and manually drawing the securing assembly along the sharpening path of travel.

10. The method of claim 7 including selectively uncoupling the drive mechanism from the securing assembly subsequent to drawing the blade across the sharpening surface to permit free rotation of the blade manually about the longitudinal direction as the blade is moved along the sharpening path of travel.

* * * * *